US008749387B2

(12) United States Patent
Fawcett et al.

(10) Patent No.: US 8,749,387 B2
(45) **Date of Patent: *Jun. 10, 2014**

(54) MERCHANDISE DISPLAY SECURITY SYSTEM INCLUDING MAGNETIC SENSOR

(71) Applicant: InVue Security Products Inc., Charlotte, NC (US)

(72) Inventors: Christopher J. Fawcett, Charlotte, NC (US); David N. Berglund, Charlotte, NC (US); David P. Christianson, Charlotte, NC (US)

(73) Assignee: InVue Security Products Inc., Charlotte, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/031,186

(22) Filed: Sep. 19, 2013

(65) Prior Publication Data

US 2014/0015674 A1 Jan. 16, 2014

Related U.S. Application Data

(63) Continuation of application No. 13/048,164, filed on Mar. 15, 2011, now Pat. No. 8,564,438.

(60) Provisional application No. 61/314,241, filed on Mar. 16, 2010.

(51) Int. Cl.
*G08B 13/14* (2006.01)

(52) U.S. Cl.
USPC ..... 340/568.8; 340/568.1; 340/571

(58) Field of Classification Search
USPC ..... 340/568.8, 568.1, 568.2, 568.4, 571
See application file for complete search history.

(56) References Cited

U.S. PATENT DOCUMENTS 3,636,547 A 1/1972 Brace et al.
3,932,857 A 1/1976 Way et al.

(Continued)

FOREIGN PATENT DOCUMENTS

JP 05-143875 A 6/1993
JP 08-044959 A 2/1996
JP 2000-339556 A 12/2000
JP 2009-532121 A 9/2009

OTHER PUBLICATIONS

Hyeon Hong Lee, International Search Report of PCT/US20111028591, pp. 1-8, Oct. 11, 2011, Korean Intellectual Property Office, Daejeon, Republic of Korea.

(Continued)

*Primary Examiner* — Toan N Pham
(74) *Attorney, Agent, or Firm* — InVue Security Products Inc.

(57) ABSTRACT

A merchandise display security system for displaying and protecting an item of merchandise having a movable or removable cover includes a sensor configured to be attached to the cover. The sensor may include a magnet assembly that produces a magnetic field defining a predetermined minimum strength when the sensor is attached to the cover and the cover is closed on the item of merchandise. A transducer detects the presence of the magnetic field, or alternatively, changes in the strength of the magnetic field and generates an electrical signal corresponding to the strength of the magnetic field, for example an output voltage. The transducer communicates the electrical signal to electronics that activate an alarm if the strength of the magnetic field is less than a predetermined minimum strength or greater than a predetermined maximum strength.

20 Claims, 4 Drawing Sheets

(56) References Cited

U.S. PATENT DOCUMENTS

| | | | |
|---|---|---|---|
| 5,739,514 | A | 4/1998 | Uchida |
| 6,970,095 | B1 | 11/2005 | Lee et al. |
| 7,299,578 | B2 | 11/2007 | Molinaro |
| 7,327,276 | B1 | 2/2008 | Deconinck et al. |
| 7,564,351 | B2 | 7/2009 | Nagelski et al. |
| 7,614,601 | B2 | 11/2009 | Marsilio et al. |
| 7,626,500 | B2 | 12/2009 | Belden, Jr. et al. |
| 7,701,339 | B2 | 4/2010 | Irmscher et al. |
| 7,710,266 | B2 | 5/2010 | Belden, Jr. et al. |
| 7,724,135 | B2 | 5/2010 | Rapp et al. |
| 7,740,214 | B2 | 6/2010 | Marsilio et al. |
| 8,013,740 | B2 | 9/2011 | Irmscher et al. |
| 8,564,438 | B2 * | 10/2013 | Fawcett et al. ..... 340/568.8 |
| 2006/0097875 | A1 | 5/2006 | Ott |
| 2007/0229259 | A1 | 10/2007 | Irmscher et al. |
| 2009/0096607 | A1 | 4/2009 | Brosnan et al. |
| 2013/0033380 | A1 | 2/2013 | Fawcett et al. |

OTHER PUBLICATIONS

Sung Chul Kang, International Search Report of PCT/US2012/049461, pp. 1-8, Feb. 26, 2013, Korean Intellectual Property Office, Daejeon, Republic of Korea.

* cited by examiner

MERCHANDISE DISPLAY SECURITY SYSTEM INCLUDING MAGNETIC SENSOR

CROSS REFERENCE TO RELATED APPLICATIONS

This non-provisional application is a continuation of U.S. application Ser. No. 13/048,164, filed on Mar. 15, 2011, which claims the benefit of priority of U.S. Provisional Application No. 61/314,241, filed on Mar. 16, 2010, each of which is incorporated herein by reference in its entirety.

FIELD OF THE INVENTION

This invention relates generally to a merchandise display security system for displaying and protecting an item of merchandise having a movable or removable battery compartment cover. In a particular embodiment, the invention is magnetic sensor configured to be attached to a demonstration model of a mobile telephone having a movable or removable battery compartment cover on a merchandise display security system operable for displaying the mobile telephone, while protecting the mobile telephone from theft.

BACKGROUND OF THE INVENTION

It is common practice for retailers to provide demonstration models of relatively expensive consumer electronics, such as a mobile (e.g. cellular) telephone, personal data assistant (PDA), portable digital media player, global positioning system (GPS), electronic reader, or the like, having a movable or removable battery compartment cover (commonly referred to a "battery door"). The demonstration model allows a potential purchaser to examine the merchandise, and in some instances, to test the operation and function of its features prior to purchasing the item. A functional demonstration model, however, also provides an opportunity for the display item to be stolen or removed from the display area by an unauthorized person. As a result, demonstration models of consumer electronics are typically protected by an anti-theft device, commonly referred to as a "security device," "merchandise security system" or "merchandise display security system," that permits a potential purchaser to examine and operate the demonstration model, while reducing the likelihood that the display item will be stolen or removed from the display area.

Certain consumer electronics are more difficult to protect than others. For example, a mobile telephone, PDA, portable digital media player, GPS, electronic reader, or the like, are relatively small and include movable or removable components that are easily separated from one another. In particular, many mobile telephones include a battery pack (or one or more individual batteries) disposed within a battery compartment having a movable or removable access panel, commonly referred to as a "battery compartment cover" or "battery door." If the mobile telephone is protected against theft, but the battery compartment cover is not protected, a potential thief can open or separate the cover from the remainder of the mobile telephone and steal the battery pack or batteries. Alternatively, if the battery compartment cover is protected, but the remainder of the mobile telephone is not protected, the potential thief can simply separate the remainder of the mobile telephone from the battery compartment cover and steal the mobile telephone sans the cover. Accordingly, both the battery compartment cover and the remainder of the mobile telephone must be protected against theft without interfering with the potential purchaser's ability to examine and operate the demonstration model. This requirement often results in the use of a merchandise display security system including two or more sensors positioned at different locations on the display product. The use of multiple sensors, however, can make it more difficult for the potential purchaser to examine and operate the demonstration model, and thus, adversely influence the purchaser's decision to purchase the item. Furthermore, the provision of multiple sensors increases the cost, as well as the complexity, of the merchandise display security system. As a result, there is a corresponding increased likelihood that the security system may malfunction or produce a false indication of theft.

As an alternative to the use of multiple sensors, the retailer may choose to permanently fix (for example seal, ultrasonically weld or adhere) the battery compartment cover to the remainder of the mobile telephone. However, fixing the battery compartment cover on the mobile telephone requires alteration of the demonstration model, resulting in additional time and labor cost, and furthermore, renders the display product unusable for purposes other than display. Permanently fixing the battery within the battery compartment likewise requires the demonstration model to be altered, thereby resulting in additional time and labor cost, and furthermore, rendering the demonstration model inoperable and unusable for other purposes if the battery fails. In addition, it may still be possible for a potential thief to steal the demonstration model, including the battery, if the merchandise display security system is inadvertently attached to only a movable or removable battery compartment cover. Some retailers prefer to utilize the battery of the mobile telephone to power the demonstration model at times when the store is open for business rather than using a separate power cord (commonly referred to as an "adapter" or "pigtail") extending from the merchandise display security system. The battery can then be recharged using the power cord and/or charger supplied with the mobile telephone at times when the store is closed for business. Using the charged battery instead of a separate power cord to power the demonstration model provides for a more aesthetic presentation of the display product by eliminating extraneous cords, cables, transformers, power packs and the like. However, the demonstration model and the battery is still vulnerable to theft if the merchandise display security system is attached to only the removable battery compartment cover. Thus, none of the aforementioned solutions is acceptable to the majority of retailers.

Accordingly, there exists an unresolved need for a merchandise display security system for displaying and protecting an item of merchandise, such as a mobile (e.g. cellular) telephone, PDA, portable digital media player, GPS, electronic reader, or the like, having a movable or removable battery compartment cover. There exists a further need for a merchandise display security system including a single sensor configured to be attached to a movable or removable battery compartment cover of a demonstration model of an item of merchandise, while protecting the demonstration model from theft. As will become apparent, there exists a specific need for a merchandise display security system including a magnetic sensor for protecting a demonstration model of a mobile telephone having a movable or removable battery compartment cover against theft.

BRIEF SUMMARY OF THE INVENTION

The aforementioned needs, objectives and advantages, as well as others readily apparent to those of ordinary skill in the art, are provided by a merchandise display security system for displaying and protecting an item of merchandise, such as a mobile (e.g. cellular) telephone, personal data assistant (PDA), portable digital media player, GPS, electronic reader, or the like, having a movable or removable battery compartment cover in accordance with the invention.

In one aspect, the invention provides a merchandise display security system for displaying an item of merchandise having a movable or removable battery compartment cover, while protecting the mobile telephone from theft. The security system includes a sensor that produces a magnetic field defining a predetermined minimum strength. The merchandise display security system activates an alarm when the strength of the magnetic field is less than the predetermined minimum strength, or alternatively, when the strength of the magnetic field exceeds a predetermined maximum strength.

In another aspect, the invention provides a sensor configured to be attached to a demonstration model of an item of merchandise having a movable or removable battery compartment cover. The sensor includes a magnet assembly that produces a magnetic field defining a predetermined minimum strength when the demonstration model is attached to the magnetic sensor. The sensor further includes a transducer that completes an electrical circuit when the strength of the magnetic field is equal to or greater than the predetermined minimum strength, and that interrupts the electrical circuit at least when the strength of the magnetic field is less than the predetermined minimum strength, to thereby activate an alarm.

In yet another aspect, the invention provides a magnetic sensor configured to be attached to a demonstration model of a mobile telephone having a battery compartment with a movable or removable battery compartment cover on a merchandise display security system operable for displaying the mobile telephone, while protecting the mobile telephone from theft. The magnetic sensor includes a magnet assembly that is disposed partially within a housing of the magnetic sensor and partially within the battery compartment of the mobile telephone. The magnetic sensor further includes a transducer that completes an electrical circuit at least when the strength of the magnetic field is equal to or greater than a predetermined minimum strength. The magnetic sensor further includes electronics for monitoring the electrical circuit and for activating an alarm when the electrical circuit is interrupted.

BRIEF DESCRIPTION OF THE DRAWINGS

The present invention is best understood by reference to the following detailed description taken in conjunction with the accompanying drawing figures in which.

DETAILED DESCRIPTION OF EXEMPLARY EMBODIMENTS OF THE INVENTION

Figure 1A:
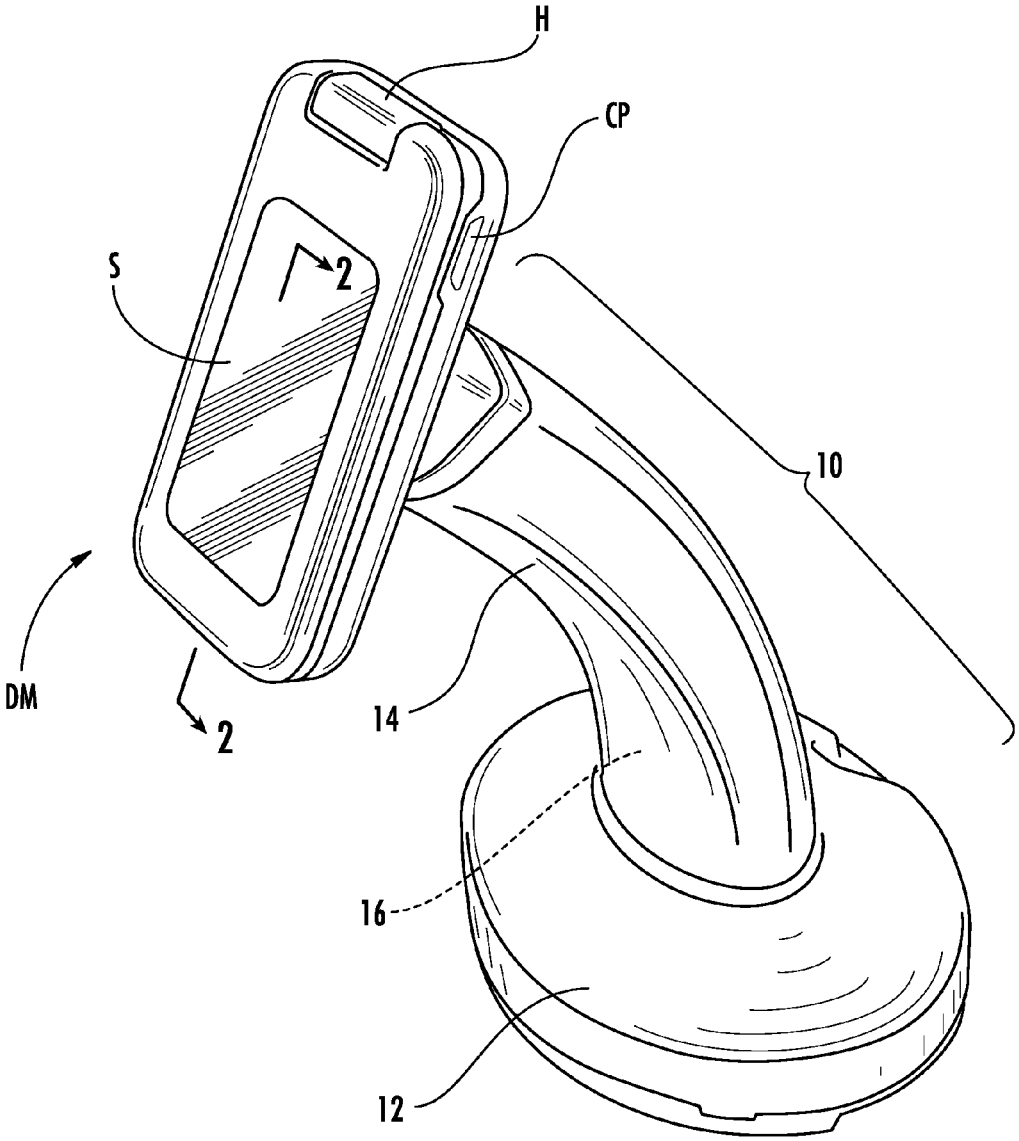
FIG. 1A is a perspective view showing an exemplary embodiment of a merchandise display security system according to the invention for displaying and protecting a demonstration model of a first type of a mobile telephone having a movable or removable battery compartment cover.
Figure 1B:
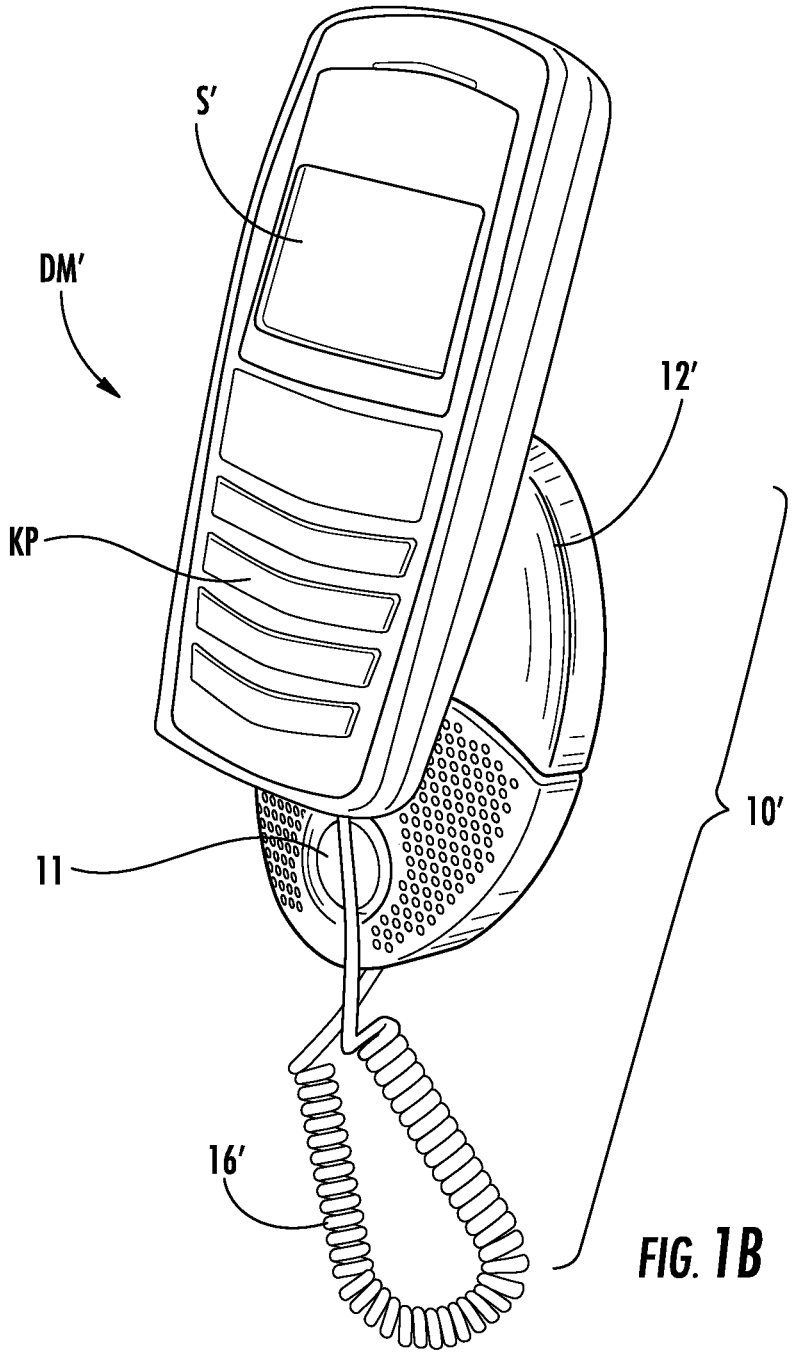
FIG. 1B is a perspective view showing another exemplary embodiment of a merchandise display security system according to the invention for displaying and protecting a demonstration model of a second type of a mobile telephone having a movable or removable battery compartment cover.
Figure 2:
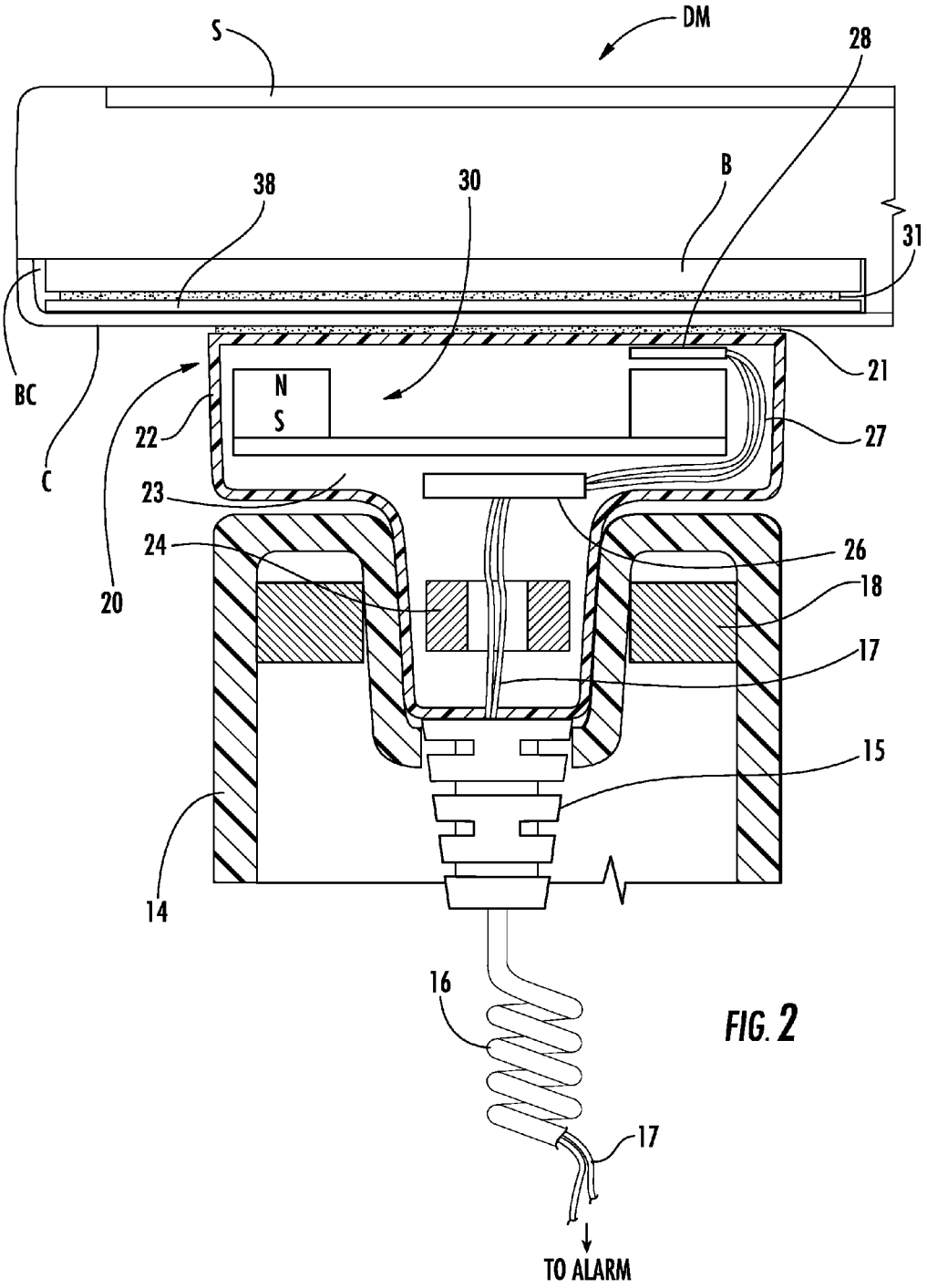
FIG. 2 is a sectional view of a portion of the merchandise display security system and the demonstration model of FIG. 1A taken at the location and in the direction indicated by section line 2-2 showing an exemplary embodiment of a sensor according to the invention.

Reference will now be made to the accompanying drawing figures wherein identical reference numerals denote the same or similar elements throughout the various views. FIG. 1A shows an exemplary embodiment of a merchandise display security system, indicated generally by reference character 10, for displaying and protecting an item of merchandise. By way of example, the item of merchandise is a demonstration model of a first type of a mobile (e.g. cellular) telephone, indicated generally by reference character DM, having a movable or removable battery compartment cover C (FIG. 2). FIG. 1B shows another exemplary embodiment of a merchandise display security system 10' for displaying and protecting a demonstration model of a second type of a mobile telephone, indicated generally by reference character DM', likewise having a movable or removable battery compartment cover (not shown). FIG. 1A and FIG. 1B illustrate that a sensor according to the present invention can be utilized with various types of merchandise display security systems as well as different types of consumer electronics having a movable or removable battery compartment cover. Accordingly, the present invention is not intended to be limited to the particular merchandise display security systems depicted herein or the particular types of mobile telephones depicted herein, or furthermore, even to demonstration models and display models of items of merchandise in general. Instead, the invention is intended to be construed broadly to include any merchandise display security system including a single sensor configured to be attached to an item of merchandise having a movable or removable battery compartment cover, including but without limitation to a mobile telephone, PDA, portable digital media player, GPS, electronic reader, or the like.

The merchandise display security system 10 shown in FIG. 1A comprises a base 12 and an upwardly extending extension 14, alternatively referred to as a neck, stem, post or extrusion. Base 12 typically houses electronics for arming and disarming a visual and/or audible alarm, and for monitoring the state of one or more sensors that indicate if the base has been separated from a support surface to which it is attached, or alternatively, if a demonstration model DM of an item of merchandise has been separated (i.e. removed) from the security system 10. Although not shown and not described herein, the electronics in the base 12 may optionally include a voltage regulator, or the like, for providing a proper operating voltage to the demonstration model DM in a known manner. The extension 14 of the security system 10 houses an extensible cable 16 (hidden in FIG. 1A, but shown in the sectional view of FIG. 2) that operatively connects the base 12 to a sensor, and as shown herein, to a magnetic sensor 20 (FIG. 2) that is removably supported on the extension 14. Magnetic sensor 20 will be described in greater detail hereinafter with reference to FIG. 2. Cable 16 mechanically connects the base 12 to the sensor 20, for example by means of a strain relief 15 (FIG. 2), and electrically connects the electronics disposed within the base 12 with electronics disposed within the sensor.

As shown herein, the demonstration model DM is a common type of a mobile (i.e. cellular) telephone comprising a screen S movably attached to the remainder of the mobile telephone by a hinge H. The screen S may provide a visual display on an inner surface, or alternatively on both an inner surface and an outer surface. Regardless, the screen S typically conceals a conventional keypad (not shown) in a closed position and presents the keypad for use in an opened position. The mobile telephone typically also comprises a charging port CP for receiving a power cord (commonly referred to as an "adapter" or "pigtail") in electrical communication with an external power source for recharging an internal battery B (FIG. 2) of the telephone. As shown, the charging port CP is a conventional miniature USB jack for receiving a miniature USB plug. However, charging port CP may be any suitable type of electrical port, jack, plug, connector, or the like.

The merchandise display security device 10' shown in FIG. 1B comprises a base 12' and a sensor hidden from view in FIG. 1B by the demonstration model DM' of the mobile telephone. For purposes of illustration, the sensor may be a magnetic sensor 20 of the type described herein with reference to FIG. 2. The magnetic sensor 20 is attached to a movable or removable cover (not shown) of the demonstration model DM' and is removably supported on the base 12' of the merchandise display security system 10'. It should be noted that the base 12' of the security system 10' does not comprise an upwardly extending extension. Instead, the demonstration model DM' is supported by means of the magnetic sensor 20 directly on an upper exterior surface of the base 12'. The magnetic sensor 20 in this case may be received via a slight interference fit within a recess formed in the base 12', or may be removably held on the base in a known manner, for example by one or more retaining magnets. Accordingly, the security system 10' is adapted to be mounted on a generally horizontal support surface, or alternatively, on a generally vertical support surface. Regardless, the base 12' typically houses electronics for arming and disarming a visual and/or audible alarm, and for monitoring the state of one or more sensors that indicate if the base has been separated from the horizontal or vertical support surface to which it is attached, or if the demonstration model DM' has been separated (i.e. removed) from the magnetic sensor 20 of the security system 10'. Although not shown or described herein, the electronics in the base 12' may optionally also include a voltage regulator, or the like, for providing a proper operating voltage to the demonstration model DM' in a known manner.

The security system 10' may further comprise a communication port 11 for receiving a communications signal via conventional electrical contacts, or a wireless communications signal, via an infrared (IR) pulse, an electromagnetic (EM) pulse, a magnetic pulse, or the like from a suitable source. Regardless, the communications port 11 provides the communications signal to the electronics disposed within the base 12' to arm and disarm the alarm. Alternatively, the communications port 11 may comprise a mechanical lock for receiving a key that engages a switch to arm and disarm the alarm in a known manner. An extensible cable 16' operably connects the base 12' to the magnetic sensor 20 in essentially the same manner as cable 16 operably connects the base 12 to the magnetic sensor 20, which will be described further hereinafter with reference to FIG. 2. More particularly, the cable 16' mechanically connects the base 12' to the magnetic sensor 20, preferably by means of a mechanical strain relief 15 (see FIG. 2), and electrically connects the electronics in the base 12' with electronics disposed within the magnetic sensor 20. As shown herein, the demonstration model DM' is a common type of mobile (i.e. cellular) telephone comprising a screen S' disposed on an upper exterior surface of the mobile telephone. The screen S' provides a visual display on the exterior surface of the mobile telephone adjacent to a conventional keypad KP in a known manner. The mobile telephone also comprises a charging port (not shown) for receiving a power cord or cable (commonly referred to as an "adapter" or "pigtail") in electrical communication with a power source for recharging an internal battery in the same manner as the battery B shown in FIG. 2.

FIG. 2 shows an exemplary embodiment of a magnetic sensor 20 according to the invention. The sensor 20 is configured to be attached to the demonstration model DM of the mobile telephone shown in FIG. 1A, and for supporting the demonstration model in a desired display orientation on the extension 14 of the merchandise display security system 10, while protecting the demonstration model from theft. Components of the security system 10, and in particular extension 14, strain relief 15 and cable 16, are shown for purposes of illustration and explanation only. As previously mentioned, the magnetic sensor 20 is usable with various types of merchandise display security systems, including without limitation the exemplary security systems 10, 10', and with demonstration models DM, DM' of different items of merchandise, and in particular, different types of consumer electronics having a movable or removable battery compartment cover C. It will be readily apparent to those skilled in the art that items of merchandise having a movable (e.g. hinged or slidable) or removable battery compartment cover C present a significant obstacle to the use of a conventional sensor, such as a pressure switch (also known as a "proximity" or "limit" switch) in contact with the cover. A pressure switch that is in an armed state when in contact with the cover C can be defeated by a potential thief since the cover can be moved and the internal battery stolen, or alternatively, the cover can be removed and the remainder of the item of merchandise stolen. Accordingly, the invention is shown and described herein with reference to a demonstration model DM of an item of merchandise, namely a mobile telephone, having a movable or removable cover C. However, the invention is not intended to be so limited, and instead, it is envisioned that a merchandise display security system and sensor according to the invention is also usable with items of merchandise not having a movable or removable cover.

As shown, the magnetic sensor 20 is received within a recess formed in the upper portion of the extension 14 of the merchandise display security system 10. The magnetic sensor 20 comprises a generally hollow housing 22 that defines an internal compartment 23 for housing the components of the sensor. The housing 22 has a generally planar exterior surface that is affixed to an exterior surface of the cover C of the demonstration model DM, for example by a relatively thin layer of an adhesive 21. A first magnet 24 disposed within a lower portion of the cavity defined by housing 22 cooperates with at least one second magnet 18 disposed within an upper portion of the extension 14. The magnets 24, 18 are operable to align the demonstration model DM in a preferred orientation relative to the base 12 of the security system 10. For example, the magnets 18, 24 may define magnetically opposite poles that align with one another in a magnetic field to orient the demonstration model DM in a desired orientation for display on the merchandise display security system 10. In an advantageous embodiment, first magnet 18 has a generally annular (i.e. ring) shape that defines "North" and "South" poles at locations approximately one hundred eighty (180) degrees apart and second magnet 24 similarly defines "South" and "North" poles that align with the "North" and "South" poles, respectively, of the first magnet 18 when the housing 22 of the magnetic sensor 20 is positioned within the recess formed in the extension 14. A "post" magnet 18 and "sensor" magnet 24 combination suitable for use with the invention is shown and described in U.S. Pat. No. 7,740,214 entitled Display Having Self Orienting-Mounting Area issued on Jun. 22, 2010, and in U.S. Pat. No. 7,614,601 entitled Centering Mechanism With Self-Oriented Mounting Area issued on Nov. 10, 2009, the disclosures of which are incorporated herein by reference in their entireties. It will be readily understood and appreciated by those skilled in the art that magnets 18, 24 in the extension 14 and magnetic sensor 20, respectively, may further be used to releasably retain the sensor and demonstration model DM on the base 12. However, it should be noted that the inclusion of magnet 18 and/or magnet(s) 24 for any purpose is optional and not required for a magnetic sensor 20 according to the invention.

The magnetic sensor 20 further comprises electronics 26, for example in the form of a printed circuit board (PCB), electrically connected to the ends of conductors 17 contained within the cable 16 extending between the base 12 and the magnetic sensor of the security system 10. Conductors 17 extend beyond strain relief 15, and if magnet 24 is present, are routed through (as shown) or around magnet 24 to electronics 26 and terminated thereon in a known manner. Electronics 26 comprise conventional electrical components that monitor the state of a magnet assembly 30 disposed within an upper portion of the housing 22 adjacent the battery compartment cover C of the demonstration model DM when the sensor 20 is affixed to the cover. By way of example, electronics 26 may indicate a "secured" state as long as an electrical circuit is completed with the magnet assembly 30 and may indicate an "unsecured" state in the event that the electrical circuit is broken or interrupted. As shown herein, electronics 26 are electrically connected by a pair of conductors 27 to a Hall Effect transducer 28 that is responsive to the presence of a magnetic field and generates an output voltage corresponding to the strength of the magnetic field. Although a Hall Effect transducer 28 or equivalent sensor is described herein, the presence of a magnetic field generated by the magnet assembly 30 may be detected and electrically communicated to the electronics 26 in any suitable manner, including by way of example and without limitation, a Reed switch magnetic sensor. Regardless, transducer 28 is responsive to the presence of, or changes in, a magnetic field produced by the magnet assembly 30 of the magnetic sensor 20 and indicates to the electronics 26 a "secured" state or an "unsecured" state of the sensor with respect to the demonstration model DM. In a further example, the transducer 28 may be configured to generate a predetermined output voltage, or alternatively, a predetermined range of output voltages corresponding to a magnetic field strength equal to or greater than a predetermined minimum strength and less than or equal to a predetermined maximum strength to indicate a "secured" state, and any other output voltage to indicate an "unsecured" state.

In an alternative embodiment, the magnet assembly 30 may be replaced by a capacitor assembly (not shown) electrically connected to the electronics 26 through conductors 27 in a conventional manner. For example, a capacitor assembly in accordance with the invention could comprise a pair of parallel capacitive plates (not shown) disposed within an upper portion of the housing 22 and positioned adjacent, but not opposite, one another. The transducer 28 would detect a capacitance of an electrical field when a capacitance sensor (in place of the magnetic sensor 20) is attached to a demonstration model DM. For example, the capacitor assembly may detect a capacitance of an electrical field defining a strength equal to or greater than a predetermined minimum strength when the capacitance sensor is affixed to the battery compartment cover C of the demonstration model DM and may detect a capacitance of an electrical field defining a strength less than the predetermined minimum strength when the demonstration model DM is separated (i.e. removed) from the sensor, or alternatively, when the remainder of the demonstration model DM is separated (i.e. removed) from the battery compartment cover C. Furthermore, the electronics 26 may be configured to recognize a range of capacitances detected by the transducer 28 corresponding to an electrical field defining a capacitance equal to or greater than the predetermined minimum strength and less than or equal to the predetermined maximum strength as a "secured" state, and any other capacitance as an "unsecured" state.

Figure 3:
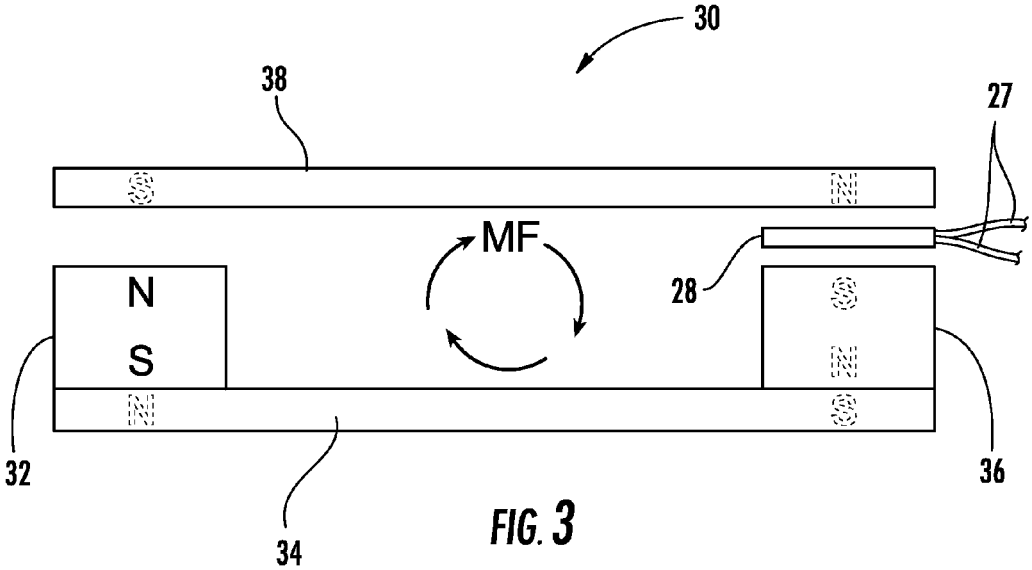
FIG. 3 is a schematic diagram illustrating components of the sensor of FIG. 2 in greater detail.

Returning to the exemplary embodiment of FIG. 3, magnet assembly 30 comprises a permanent magnet 32 that is mounted at a first end of an elongate, generally planar plate 34 made of a magnetic material. As used herein, the term "magnetic material" is intended to include without limitation ferromagnetic metals, such as iron, nickel, cobalt, rare earth metals and alloys thereof. As shown herein, the magnet 32 is a block magnet made of rare earth metals, and in particular, is a sintered Neodymium-Iron-Boron ("NdFeB"; "NIB"; or "neo") rare-earth magnet. Magnet assembly 30 further comprises a generally square or rectangular block 36 made of a magnetic material that is mounted at a second end of plate 34 opposite the first end at which magnet 32 is mounted. Magnet 32 defines a first pole (e.g. "South" pole) on a side in contact with or in close proximity to plate 34, and a second pole (e.g. "North" pole) on a side opposite the "South" pole. Accordingly, the "South" pole of magnet 32 induces a first or "North" pole at the first end of the plate 34 and a second or "South" pole at the second end of the plate 34. Likewise, the "South" pole of plate 34 induces a first or "North" pole on a side of the block 36 adjacent the plate 34 and a second or "South" pole on a side of the block 36 opposite the "North" pole. As depicted in FIG. 3, the "South" pole of block 36 is positioned adjacent the transducer 28. Magnet assembly 30 further comprises an elongate, generally planar plate 38 made of a magnetic material (e.g. ferromagnetic metal). When plate 38 is positioned opposite plate 34 with magnet 32 and block 36 disposed therebetween in the manner depicted in FIG. 3, the "North" pole of magnet 32 induces a first or "South" pole at a first end of the plate 38, while a second or "North" pole is induced at a second end of plate 38 opposite block 36. The "North" and "South" poles induced on plate 34, block 36 and plate 38 by magnet 32 are indicated in FIG. 3 by the broken (i.e. dashed) line letters "N" and "S", respectively.

The net effect of positioning the components 32, 34, 36 and 38 of the magnet assembly 30 in the manner described herein is to produce a magnetic field, indicated generally by the reference character MF in FIG. 3. As previously described, the transducer 28 detects the presence of the magnetic field MF and electrically communicates the presence of the magnetic field, or alternatively, changes in the strength of the magnetic field to the electronics 26. In particular, transducer 28 may generate an output voltage to complete an electrical circuit through conductors 27 to the electronics 26 when plate 38 is sufficiently close to the magnet 32 and block 36 to produce a magnetic field MF defining a predetermined minimum strength. In this manner, the electrical circuit through the conductors 27 will be broken (i.e. "open") when the plate 38 is separated from the magnet 32 and block 36 by a distance greater than the minimum distance necessary to produce a magnetic field MF defining the predetermined minimum strength. In addition, the transducer 28 may be operable to generate a predetermined output voltage, including for example no output voltage, if the strength of the magnetic field MF exceeds a predetermined maximum strength. As such, a potential thief cannot utilize a strong external magnet or ferromagnetic material to substitute for the plate 38. In particular, the electronics 26 may be configured to recognize a range of output voltages from the transducer 28 corresponding to a magnetic field MF defining a strength equal to or greater than the predetermined minimum strength and less than or equal to the predetermined maximum strength as a "secured" state, and any other output voltage (including no output voltage) as an "unsecured" state.

Referring again to FIG. 2, the demonstration model DM of the mobile telephone defines a generally hollow battery compartment BC for housing the battery B. The battery compartment cover C is movable or removable relative to the battery compartment BC so that battery B may be installed, removed and replaced. According to the invention, the housing 22 of magnetic sensor 20 is attached to an exterior surface of the battery compartment cover C, for example by a relatively thin layer of an adhesive 21. Likewise, the plate 38 of the magnet assembly 30 is attached to an exterior surface of the battery B, for example by a relatively thin layer of an adhesive 31, so that plate 38 is disposed between the battery B and battery compartment cover C opposite the magnetic sensor 20. In this configuration, the magnetic sensor 20 is operable for supporting the demonstration model DM in an aesthetic and non-obtrusive manner on the extension 14 of base 12 for display on the merchandise display security system 10, while preventing theft of the battery B and/or the remainder of the demonstration model DM by moving and/or removing the battery compartment cover C relative to the battery compartment BC, as previously described.

In operation, the battery compartment cover C of the demonstration model DM is first moved or removed and plate 38 is affixed to the underside of battery B, for example using adhesive 31. Battery compartment cover C is then repositioned or replaced (i.e. closed) on the demonstration model DM, such that plate 38 is disposed between battery B and battery compartment cover C. Housing 22 of the magnetic sensor 20 is then affixed to the exterior surface of battery compartment cover C, for example using adhesive 21, so that plate 38 is disposed opposite magnet 32 and block 36. For convenience, transducer 28 is positioned between plate 38 and block 36, as shown in FIG. 2. With magnetic sensor 20 attached to the battery compartment cover C of the demonstration model DM, a magnetic field MF is produced that defines a predetermined minimum strength sufficient to be detected by transducer 28. In response to the presence of the magnetic field MF, transducer 28 generates an electrical signal, for example a corresponding output voltage, and communicates the electrical signal to electronics 26 via conductors 27. In the event that the demonstration model DM (including battery compartment cover C) is separated from the magnetic sensor 20 of the security system 10 a sufficient distance, the strength of the magnetic field MF will be reduced below the predetermined minimum strength. In response thereto, the transducer 28 will communicate a corresponding output voltage, or alternatively, will discontinue communicating an electrical signal (i.e. no output voltage) to the electronics 26 to create an open circuit condition. The strength of the magnetic field MF likewise will be reduced below the predetermined minimum strength in the event that the remainder of the demonstration model DM (including the battery B) is separated from the battery compartment cover C and moved the sufficient distance from the magnetic sensor 20. When an "open circuit" electrical signal is received from the transducer 28, or alternatively, no electrical signal is received, electronics 26 will generate an alarm signal to activate an audible and/or visual alarm located in the base 12 of the merchandise display security system 10 or other convenient location. In the event that the plate 38 is substituted with an external magnet or ferromagnetic material that produces a magnetic field MF defining a strength greater than a predetermined maximum strength, transducer 28 will generate a corresponding output voltage (or no output voltage) and electrically communicate an "open circuit" electrical signal (or no electrical signal) so that electronics 26 activate the alarm, as previously described. Conversely, as long as the strength of the magnetic field MF is no less than the predetermined minimum strength and no greater than the predetermined maximum strength, transducer 28 will communicate a "closed circuit" electrical signal to the electronics 26 and the alarm will not be activated. As a result, any "unsecured" state or other condition that interrupts the communication of an electrical signal by transducer 28 to electronics 26 will activate the alarm to alert store personnel of a potential theft of the demonstration model DM or the battery B.

The foregoing has described one or more exemplary embodiments of a merchandise display security system for displaying and protecting an item of merchandise, such as a mobile (e.g. cellular) telephone, personal data assistant (PDA), portable digital media player, global positioning system (GPS), electronic reader, or the like, having a movable or removable battery compartment cover. In advantageous embodiments, the invention is a merchandise display security system including a magnetic sensor for supporting a demonstration model of a mobile telephone having a movable or removable cover for display on the merchandise display security system, while protecting the mobile telephone from theft. In the exemplary embodiments shown and described herein, the magnetic sensor includes a magnet assembly that produces a magnetic field defining a predetermined minimum strength when a demonstration model of an item of merchandise having a movable or removable cover, and more particularly a battery of the demonstration model, is in sufficiently close proximity to the magnetic sensor with a plate made of a magnetic material affixed to the battery and disposed within a battery compartment of the demonstration model.

Although exemplary embodiments of the present invention have been shown and described, it will be apparent to those skilled in the art that various modifications thereto can be made without departing from the spirit and scope of the invention or any appended claim. The foregoing description of exemplary embodiments and the best mode for practicing the invention are provided for the purpose of illustration only. In particular, it will be appreciated that a sensor in accordance with the present invention is usable with various merchandise display security systems and with different types of items of merchandise and objects having a movable or removable cover other than the mobile telephones shown and described herein.

That which is claimed is:

1. A merchandise display security device configured to support an item of merchandise on a merchandise display security system for display, while protecting the item of merchandise from theft, the merchandise display security device comprising:

a sensor attached to an item of merchandise; and a base configured to removably support the sensor and the item of merchandise thereon such that the sensor and the item of merchandise are configured to be removed from the base for inspection by a user, wherein an electrical field or a magnetic field is configured to be generated between the sensor and the item of merchandise, and wherein an alarm signal is configured to be generated in response to a change in the proximity of the item of merchandise relative to the sensor based on the strength of the electrical or magnetic field.

2. The merchandise display security device of claim 1, further comprising a cable mechanically connecting the base to the sensor.

3. The merchandise display security device of claim 1, wherein the sensor is configured to generate an electrical or a magnetic field that defines a predetermined minimum strength when the sensor is attached to the item of merchandise, and wherein the sensor is configured to generate an alarm signal when the strength of the electrical or magnetic field is less than the predetermined minimum strength.

4. The merchandise display security device of claim 1, wherein the sensor is attached to a movable or removable cover of the item of merchandise, and wherein the sensor is configured to generate an alarm signal if the sensor is separated from the cover or if the cover is removed from the item of merchandise.

5. The merchandise display security device of claim 1, wherein the sensor comprises a capacitor assembly for producing an electrical field that defines a predetermined minimum strength when the sensor is attached to the item of merchandise, and wherein the sensor is in an "unsecured" state when the strength of the electrical field is less than the predetermined minimum strength.

6. The merchandise display security device of claim 5, wherein an alarm signal is configured to be activated when the sensor is in the "unsecured" state.

7. The merchandise display security device of claim 1, wherein the sensor comprises a magnet assembly for producing a magnetic field that defines a predetermined minimum strength when the sensor is attached to the item of merchandise, and wherein the sensor is in an "unsecured" state when the strength of the magnetic field is less than a predetermined minimum strength.

8. The merchandise display security device of claim 7, wherein an alarm signal is configured to be activated when the sensor is in the "unsecured" state.

9. The merchandise display security device of claim 1, wherein the base comprises electronics for arming and disarming a visual and/or audible alarm, and wherein the electronics are in communication with the sensor.

10. The merchandise display security device of claim 9, wherein the base comprises a communications port configured to facilitate communication with the electronics to arm and disarm the visual and/or audible alarm.

11. The merchandise display security device of claim 1, wherein the sensor is configured to generate an electrical field.

12. The merchandise display security device of claim 1, wherein the sensor comprises electronics and a transducer in electrical communication with the electronics, and wherein the transducer is configured to generate an output voltage indicative of the strength of the electrical or magnetic field and to communicate the output voltage to the electronics.

13. The merchandise display security device of claim 1, wherein the sensor is configured to detect the proximity of the item of merchandise relative to the sensor based on the electrical or magnetic field, and wherein the sensor is further configured to generate an alarm signal based on a change in strength of the electrical or magnetic field.

14. A method for displaying and protecting an item of merchandise removably supported on a base from theft, the item of merchandise being configured to be removed from the base for inspection by a user, the method comprising:

generating an electrical field or a magnetic field between the item of merchandise and sensor attached to the item of merchandise;

detecting the proximity of the item of merchandise relative to the sensor based on the electrical or magnetic field; and generating an alarm signal based on a strength of the electrical or magnetic field.

15. The method of claim 14, wherein generating comprises generating an electrical field with the sensor.

16. The method of claim 14, further comprising determining whether the strength of the electrical or magnetic field is less than a predetermined minimum strength.

17. The method of claim 16, further comprising generating a visual and/or an audible alarm when the strength of the electrical or magnetic field is less than the predetermined minimum strength.

18. The method of claim 14, further comprising generating an output voltage indicative of the strength of the electrical or magnetic field.

19. The method of claim 14, further comprising generating a visual and/or an audible alarm based on the alarm signal.

20. A merchandise display security device configured to support an item of merchandise on a merchandise display security system for display, while protecting the item of merchandise from theft, the merchandise display security device comprising:

a sensor attached to an item of merchandise; and a base configured to removably support the sensor and the item of merchandise thereon such that the sensor and the item of merchandise are configured to be removed from the base for inspection by a user, wherein the sensor is configured to generate an electrical field and to detect the proximity of the item of merchandise relative to the sensor based on the electrical field, and wherein the sensor is further configured to generate an alarm signal based on a change in strength of the electrical field.

* * * * *